US005551683A

United States Patent [19]

Donaldson et al.

[11] Patent Number: 5,551,683

[45] Date of Patent: Sep. 3, 1996

[54] COMPACT ENCODER WITH POWER-ASSISTED HAND-DROP CAPABILITY

[75] Inventors: Stuart G. Donaldson, Kirkland; James M. Graverholt, Stanwood; Kevin M. Bagley, Everett; Richard W. Witbeck, Snohomish, all of Wash.

[73] Assignee: Maverick International, Inc., Mukilteo, Wash.

[21] Appl. No.: 346,629

[22] Filed: Nov. 30, 1994

[51] Int. Cl.[6] ..... B65H 3/44

[52] U.S. Cl. ..... 271/9.09; 271/110

[58] Field of Search ..... 271/9, 4.09, 110, 271/265.01

[56] References Cited

U.S. PATENT DOCUMENTS

| | | | |
|---|---|---|---|
| 4,980,704 | 12/1990 | Fulton et al. | 271/9 |
| 5,072,923 | 12/1991 | coy | 271/9.09 X |
| 5,219,156 | 6/1993 | Mori | 271/110 |
| 5,379,994 | 1/1995 | Kushida | 271/9 |

FOREIGN PATENT DOCUMENTS

| | | | |
|---|---|---|---|
| 3027146 | 2/1981 | Germany | 271/9 |
| 0277533 | 12/1986 | Japan | 271/9 |
| 0051244 | 3/1991 | Japan | 271/9 |
| 0043066 | 2/1993 | Japan | 271/9 |

OTHER PUBLICATIONS

Hunt, Priority Insertion Card Mechanism, Sep. 1974, IBM Technical Disclosure Bulletin vol. 17, No. 4, p. 958, 271/9.

*Primary Examiner*—William E. Terrell
*Assistant Examiner*—Tamara Kelly
*Attorney, Agent, or Firm*—Jensen & Puntigam, P.S.

[57] ABSTRACT

A hand-drop motor assembly for use in an encoding apparatus is positioned in the vicinity of a hand-drop region of the encoder check guide path. It includes a motor which has a motor shaft extending out the top end thereof. Mounted to the shaft is a roller. Rotatably mounted to the motor shaft is a bracket, upon which is mounted a wheel, which is in compressive contact with the roller. When the motor is turned on, the bracket rotates such that the wheel moves into the hand-drop region, contacting a document therein and then moves the document along the check guide path to an encoder station.

6 Claims, 2 Drawing Sheets

COMPACT ENCODER WITH POWER-ASSISTED HAND-DROP CAPABILITY

TECHNICAL FIELD

This invention relates generally to document encoders and, more specifically, concerns an improvement to such encoders relating to the hand-dropping of documents into the encoder.

BACKGROUND OF THE INVENTION

Document encoders are used in a variety of situations to accomplish a number of different tasks, among them being coding of checks. Checks are encoded to facilitate processing of those checks against a bank account. The encoding is typically done in a bank or other central facility. At times, however, it is desirable to encode checks at the retail level, such as at a grocery store, so as to decrease the overall processing time of those checks through the banking system. Such encoders are often used as part of an overall cash settlement system, instead of operating as a stand-alone instrument.

Typically, processing speed, as well as accuracy, is extremely important in any such check encoder. Many encoders use a hand drop channel, where documents are fed into a channel by an operator, who obtains them from a separate tray. Other encoders include an attached tray at the front end of the apparatus, with the tray holding a selected number of documents. The trays are part of an auto-feed system, by which documents are successively fed from the tray to the encoder. Even the auto-feed encoders, however, usually have a hand drop capability. In both cases, the encoder will, after encoding has been completed, eject the encoded check into a collection tray.

The hand-feed capability can be implemented in a variety of ways, but typically they involve the user hand-dropping a check into a slot, and then moving the check until it comes into contact with feed rollers, where it is clamped, with the rollers then moving the check to the encoder station. Usually such systems have two sensors, to ensure that the document is both down against the bottom of the slot and to determine its forward edge position. Efficiency, reliability and processing speed are important considerations for hand-drop systems as well as auto-feed systems. It is desirable to have a hand-drop encoder capability which is convenient to use and which produces accurate, reliable feeding of the check to the encoder.

SUMMARY OF THE INVENTION

Accordingly, the present invention is an improvement in a MICR encoder, which includes a document feed assembly for moving documents into a document guide path which extends past an encoding station. The improvement includes a document guide portion located directly upstream of the encoding station in the document guide system, the document guide portion defining a hand-drop region for documents to be encoded; further, a hand-drop roller assembly means, including a wheel for contacting the hand-dropped documents and moving them to the encoder station; and further, a motor for driving the roller wheel.

BEST MODE FOR CARRYING OUT THE INVENTION

Figure 1:
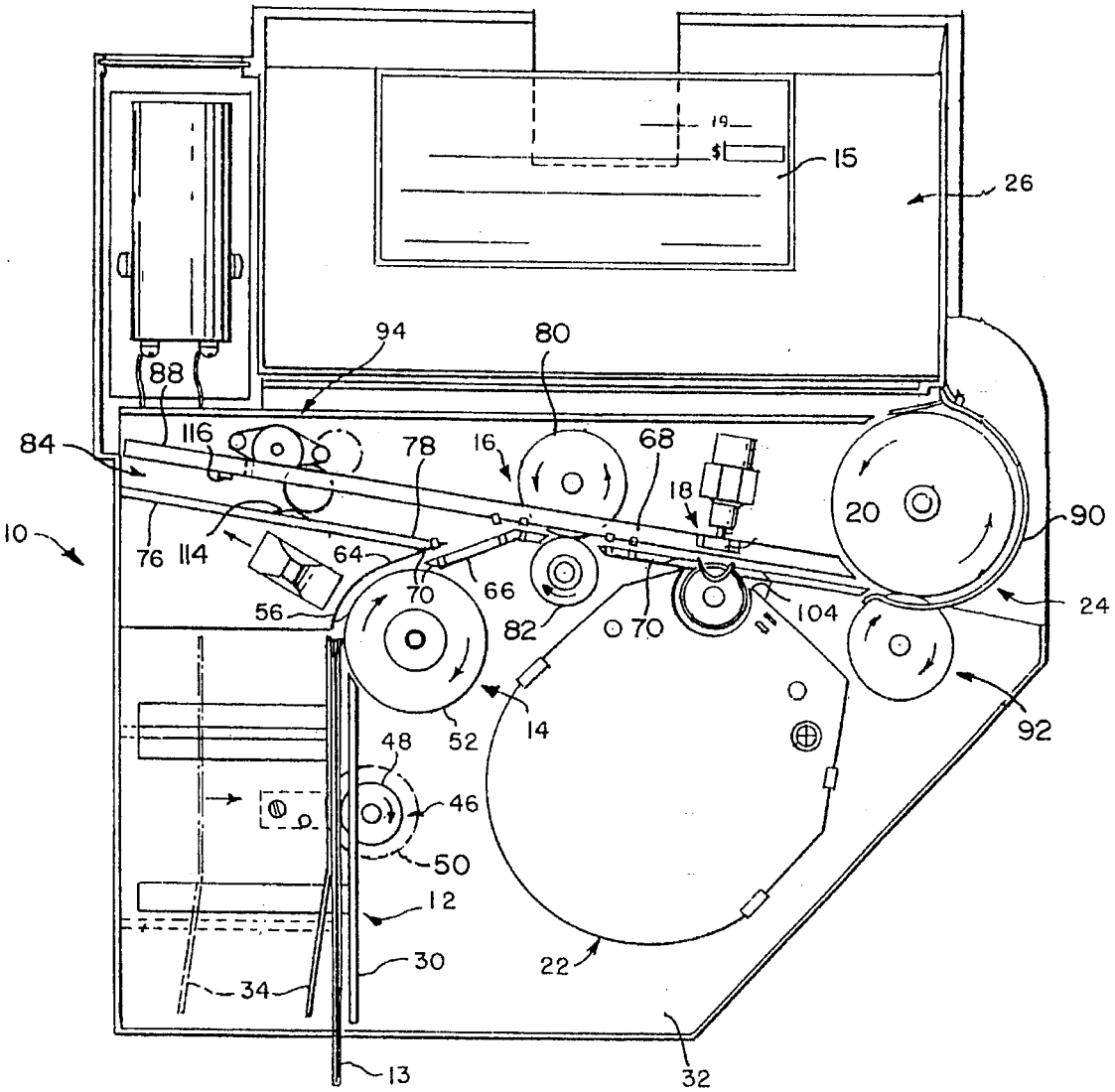
FIG. 1 is a top plan view of an encoder in which the present invention can be used.
Figure 2:
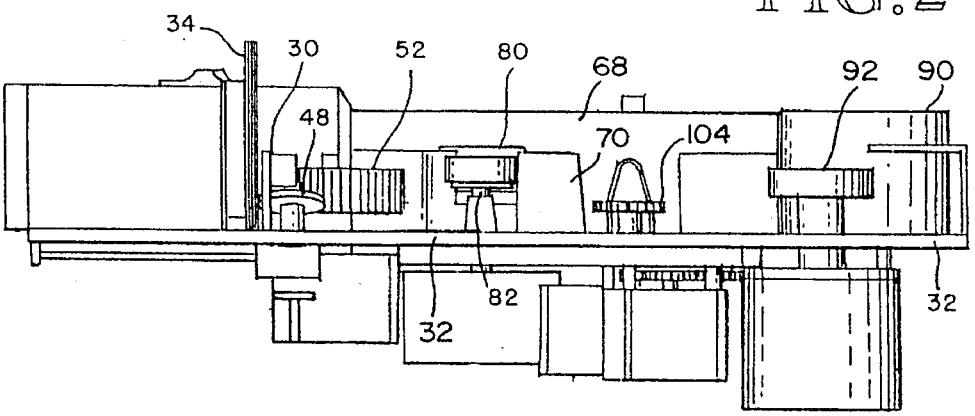
FIG. 2 is a side elevational view of the apparatus of FIG. 1.

FIGS. 1 and 2 show, in general, the structure of a document encoder which includes the improvement of the present invention. This particular encoder includes an auto-feed capability. Referring to FIG. 1, in particular, the apparatus, shown generally at 10, includes an auto-feed tray assembly 12, where a number of checks or other documents 13 are initially stored for encoding. An auto-feed roller assembly is shown downstream of the tray assembly at 14, while a check encoding system, positioned downstream of the auto-feed roller assembly 14 includes a first drive assembly 16, a printing assembly 18, and a second drive (eject) assembly 20. A ribbon cartridge 22 forms part of the printing assembly 18. Downstream of the check encoding system is a check eject assembly 24, which ejects encoded checks 15 into a catch assembly 26.

In the particular encoder shown, the various assemblies are arranged so that the resulting encoder apparatus is quite compact and presents a relatively small footprint, yet is also reliable and capable of an extremely high throughput rate. The auto-feed tray assembly 12 and the catch assembly 26 furthermore are structurally integrated into the apparatus, so that it is a unitary structural and operational unit, controlled by a microprocessor. One of the advantages of the unitary structure approach is less expense relative to separate units.

More specifically, still in reference to FIGS. 1 and 2, the auto-feed tray assembly 12 includes a fixed reference plate 30 which in the embodiment shown extends in an upright position from a base plate 32 of the apparatus. To the left of reference plate 30 in FIG. 1 is a movable pressure plate 34. The movable pressure plate 34 is supported such that it is free to move toward and away from reference plate 30 and, in the embodiment shown, is spring-loaded so that it tends to maintain pressure in the direction of reference plate 30.

Checks 13 to be encoded are inserted into the tray assembly 12 by moving movable pressure plate 34 away from reference plate 30. A deskewing roller assembly 46 contacts the checks in the tray assembly as they move to auto-feed roller assembly 14. Deskewing roller assembly 46 includes a circular roller element 48 mounted on a shaft which extends through base plate 32 and is slightly inclined toward the downstream end of reference plate 30, toward the auto-feed roller assembly 14. The deskewing roller assembly 46 may be spring-biased in the direction of pressure plate 34, contacting the front surface of the first check in the stack between pressure plates 30 and 34. Checks moved out of the tray assembly are forced downwardly against the base plate 32 by the action of the deskewing roller assembly. The auto-feed roller assembly includes a drive motor 54 and a check stripper element 56. The auto-feed roller assembly further includes a serrated edge roller 52. The check stripper element is located immediately downstream of pressure plate 34. Auto feed roller 52 moves the checks from the tray assembly since the leading edge of the front most check comes into contact with the edge of roller 52 because of the action of pressure plate 34.

Check stripper element 56 is mounted on a curved wall section 64, which extends through an arc of approximately 80° to 85° around a portion of the feed roller 52. Wall section 64, along with base plate 32 and the feed roller, forms a first section of a check guide path, along which the check moves through the apparatus following its removal from the auto-feed tray.

As the check moves around the auto-feed roller and then out of contact with the auto-feed roller, it encounters a second section of the check guide path, defined by wall 66 and base plate 32. The second section is at an angle of approximately 20° to 30° relative to a path of travel around the roller, i.e. it is the angle at which a check leaves the feed roller 52.

This second section then angles into a third check path section, defined between spaced walls 68 and 70, which leads past a first drive assembly 16, which includes a roller element 80 and a mating roller 82. This first pair of rollers moves the check past the printing assembly 18 to the eject assembly 20, which includes eject roller 90 and drive roller 92, which move the encoded check around the eject roller 90 and from there to the catch assembly 26.

In addition to the above-described elements, the encoder of FIGS. 1 and 2 includes a number of sensing elements and deskewing elements in order to keep track of the position of the check, to operate the various encoder mechanisms in proper sequence and maintain the check in the check path. Although a particular encoder configuration has been described for illustration, it should be understood that the present invention can be used with other encoder arrangements.

Referring to FIG. 1, a hand-drop portion of the check guide path is referred to generally at 84. Hand-drop portion 84 is an extension of the third check path section, extending away from the first roller assembly 16 in the opposite direction from the printing system 18. The hand-drop portion 84 and the third check path section thus define one continuous and straight path for movement of the check, although in the embodiment shown the width of the hand-drop portion is somewhat greater than that of the third check path portion.

Hand-drop portion 84 extends to the left hand edge of the apparatus such that a check can be ejected backwardly out of the encoder. It is defined between rear wall member 68 and a forward wall member 76, which at one end 78 joins the downstream edge of curved wall portion 64.

Figure 3:
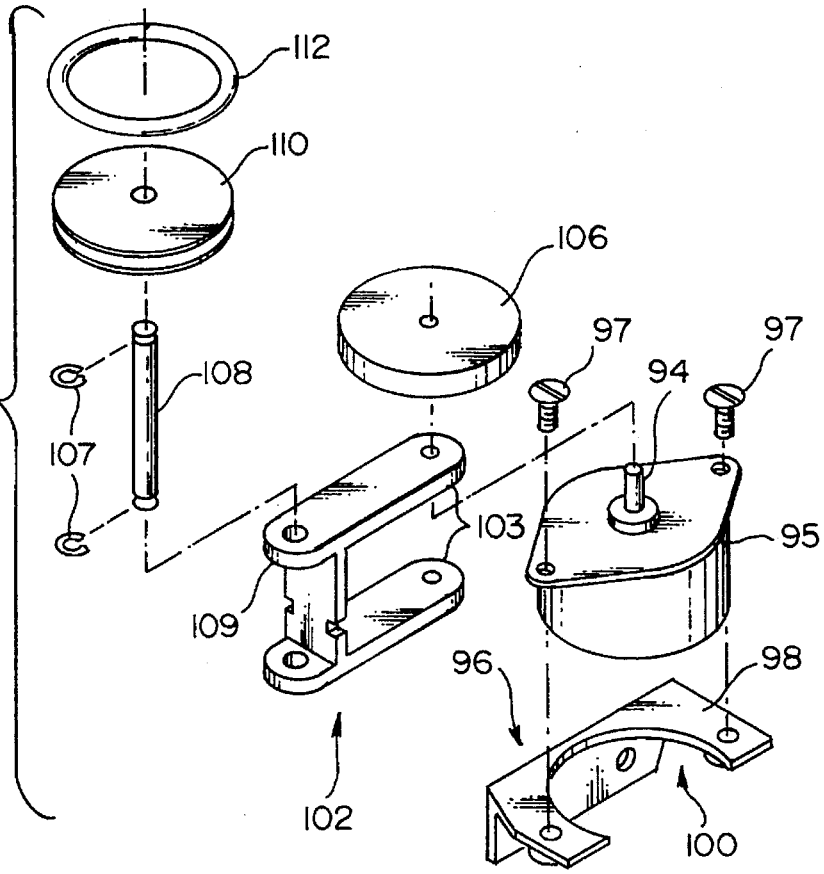
FIG. 3 is an exploded view of the hand drop assembly of the present invention.

Secured to the rear surface 88 of wall member 68 is the hand-drop motor assembly 94 of the present invention, which is shown in detail in FIG. 3. A fixed bracket 96 is attached by screws or the like to the rear surface 88 of wall member 68 and a stepper motor 95 is secured to the upper portion 98 of bracket 96 by screws 97 or the like. The upper portion 98 of bracket 96 includes a hemispherical edge section 100 against which the body of motor 95 fits. The rotating shaft 94 of motor 95 extends upwardly from the upper end of the body of motor 95. A swinging bracket 102 is rotatably mounted at one end 103 thereof about shaft 94 and an extending pin on the opposite end of motor 95. Bracket 102 is open so that it is free to swing about motor 95.

Fixedly connected to shaft 94 above bracket 102 is a circular metal roller 106. When motor 95 is turned on, shaft 94 turns and with it metal roller 106. At the other end 109 of bracket 102 is mounted a rod 108, held in place by clip washers 107, which snap into grooves at each end of the rod. Rod 108 is rotatable within bracket 102. Rod 108 extends above the upper surface of bracket 102 a small amount, and a wheel 110 is mounted at the end of the rod 108, with one of the clip washers 107 holding the wheel 110 against the upper surface of the bracket. A flexible O-ring element 112 is mounted in the peripheral edge of wheel 110. Rod 108 is tilted slightly so that wheel 110 is angled downwardly slightly in the direction away from motor 95.

The peripheral edge of the metal roller 106 and O-ring 112 are in physical contact, compressing slightly the O-ring, such that clockwise rotation of metal roller 106, which occurs when motor 95 is running, results initially in a clockwise movement of bracket 102, because of the compressive contact between roller 106 and O-ring 112.

Wall member 68 has a slot in it in the vicinity of motor assembly 94, such that when motor 95 is turned on and metal roller 106 rotates, the resulting rotation of bracket 102 will result in wheel 110 and O-ring 112 extending partially through the slot into the opening between the wall members 68 and 76. This movement of bracket 102 and wheel 110 is shown in FIG. 1.

Extending into the gap of hand drop portion 84 from wall member 76 is a slight protrusion 114. In some cases, the protrusion may not be necessary. When motor 95 is running, O-ring 112 on wheel 110 tends to pressure the document, which is intermediate of the wheel and the protrusion, against the protrusion 114. Since bracket 102 can thereafter rotate no further, the continued rotation of roller 106 will cause wheel 110 to counterrotate (in the opposite direction from roller 106). Counterrotation will cause the check to move toward the encoder station. In a variation, the protrusion could be moved slightly such that it is spaced slightly laterally away from wheel 110, even when wheel 110 is fully into the gap. As indicated above, the compressive contact between O-ring 112 and roller 106 is such that when roller 106 rotates, bracket 102 initially rotates with roller 106 and then when bracket 102 can rotate no farther, wheel 110 begins to counterrotate. When the motor is reversed, bracket 102 rotates with it and wheel 110 moves out of the gap.

In operation, wheel 110 is initially out of the gap, and a check is hand-inserted. A sensor 116 detects the presence of the hand-dropped check. This in turn results in motor 95 being turned on, which results in wheel 110 swinging into the gap, against the check. Wheel 110 then begins to counterrotate, moving the check under positive control along the check guide path to the point where it comes under control of the first feed roller assembly 16, and out of control of the hand-drop motor assembly 94, at which point motor 95 is reversed to move the wheel back out of the gap. The slightly downward tilt of Wheel 110, described above, provides a deskewing effect on the check as it moves, tending to force it downwardly against the bottom surface of the check guide path.

Hence, the present invention provides a reliable and convenient means for receiving checks which are hand-dropped into an encoder apparatus, and for positively driving those checks to the encoding station, including deskewing the check. The close tolerances of existing hand-drop arrangements are significantly relaxed.

Although a preferred embodiment of the invention has been disclosed for illustration, it should be understood that various changes, modifications and substitutions may be incorporated in such embodiment without departing from the spirit of the invention, which is defined by the claims which follow.

What is claimed is:

1. In a MICR encoder, which includes a document feed assembly for moving the documents into a document guide path which extends past an encoding station, the improvement comprising:

a document guide portion, located directly upstream from the encoding station, which defines a hand-drop region for documents to be encoded;

a hand-drop roller assembly means, including a motor having a motor shaft and a roller fixedly mounted on the motor shaft and further including a support member which is rotatably mounted on the motor shaft and a wheel rotatably mounted on the support member, such that the wheel is in frictional contact with said roller, so that when the motor is turned on, the roller initially rotates the support member from a first position in which the wheel thereon is away from the hand-drop region into a second position in which the wheel is within the hand-drop region, clamping the hand-dropped document, wherein continued rotation of the roller results in a counterrotation of the wheel, which moves the document along the check guide path to the encoder station; and means for turning the motor on when the presence of a document is sensed in the hand-drop region.

2. An apparatus of claim 1, wherein the document guide includes front and rear spaced walls which define a gap therebetween, wherein the motor is mounted to a rear surface of the rear wall, the rear wall including a slot therein through which the wheel moves when the motor is turned on.

3. An apparatus of claim 2, including a protrusion extending inwardly of the gap from the forward wall, arranged so that in operation when a document is placed by an operator in the hand-drop region, and the motor is turned on, the document is in contact with the protrusion on one side thereof and with the wheel on the other side, the document being thus driven toward the encoder station along the document guide path.

4. An apparatus of claim 3, wherein the protrusion is arranged such that the wheel moves the document directly against the protrusion.

5. An apparatus of claim 1, wherein the motor includes reversing means so that when the roller rotates in an opposite direction, the bracket rotates therewith, moving the wheel out from the hand-drop region.

6. An apparatus of claim 1, wherein the encoder includes a tray for storing documents to be encoded and wherein the document feed assembly includes means for moving documents from the tray into the document feed path.

* * * * *